United States Patent [19]

Comeau

[11] Patent Number: 4,607,677

[45] Date of Patent: Aug. 26, 1986

[54] MOUNTING FOR BLIND

[75] Inventor: Paul E. Comeau, Warwick, R.I.

[73] Assignee: Kenney Manufacturing Company, Warwick, R.I.

[21] Appl. No.: 643,821

[22] Filed: Aug. 23, 1984

[51] Int. Cl.[4] ..... E06B 9/388; A47H 1/144

[52] U.S. Cl. ..... 160/84 R; 160/178 B; 248/264

[58] Field of Search ..... 160/84 R, 178 B; 248/264, 221.4

[56] References Cited

U.S. PATENT DOCUMENTS

| | | | |
|---|---|---|---|
| 1,056,108 | 3/1913 | Lunken | 160/84 R |
| 2,350,094 | 5/1944 | Butts | 160/84 R |
| 2,486,996 | 11/1949 | Stuber et al. | 248/264 |
| 2,526,393 | 10/1950 | Nelson | 160/178 B |
| 3,003,812 | 10/1961 | Haugland | 160/84 R |
| 3,913,655 | 10/1975 | Ogino | 160/84 R |
| 4,224,974 | 9/1980 | Anderson et al. | 260/178 R |
| 4,265,423 | 5/1981 | Vecchiarelli | 248/264 |
| 4,422,492 | 12/1983 | Bledsoe | 160/84 R |

FOREIGN PATENT DOCUMENTS

| | | | |
|---|---|---|---|
| 61284 | 8/1943 | Denmark | 160/84 R |

*Primary Examiner*—Ramon S. Britts
*Assistant Examiner*—Cherney S. Lieberman
*Attorney, Agent, or Firm*—Russell & Tucker

[57] ABSTRACT

A bracket for supporting the headrail of a venetian or pleated blind is provided with housings each having a partially open bottom and a detachable pivoting front plate to facilitate access to the interior of the bracket while mounting it on a wall, and to support the end of the headrail when the front plate is pivoted to the closed position. The housings are righthand or lefthand, but the front plate is interchangeable. The partially open bottom of the housing permits a pleated blind to be attached to one face of the headrail by means of a retaining member extending the full length of the headrail and to support the blind along a line forward of the rear of the headrail.

10 Claims, 6 Drawing Figures

FIG. 1
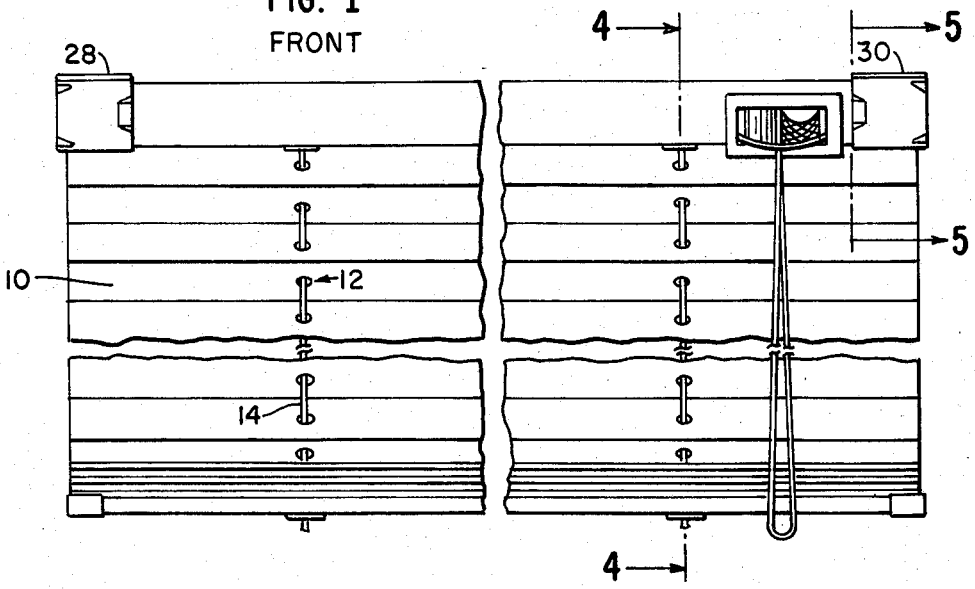
FIG. 2
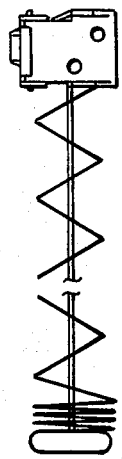
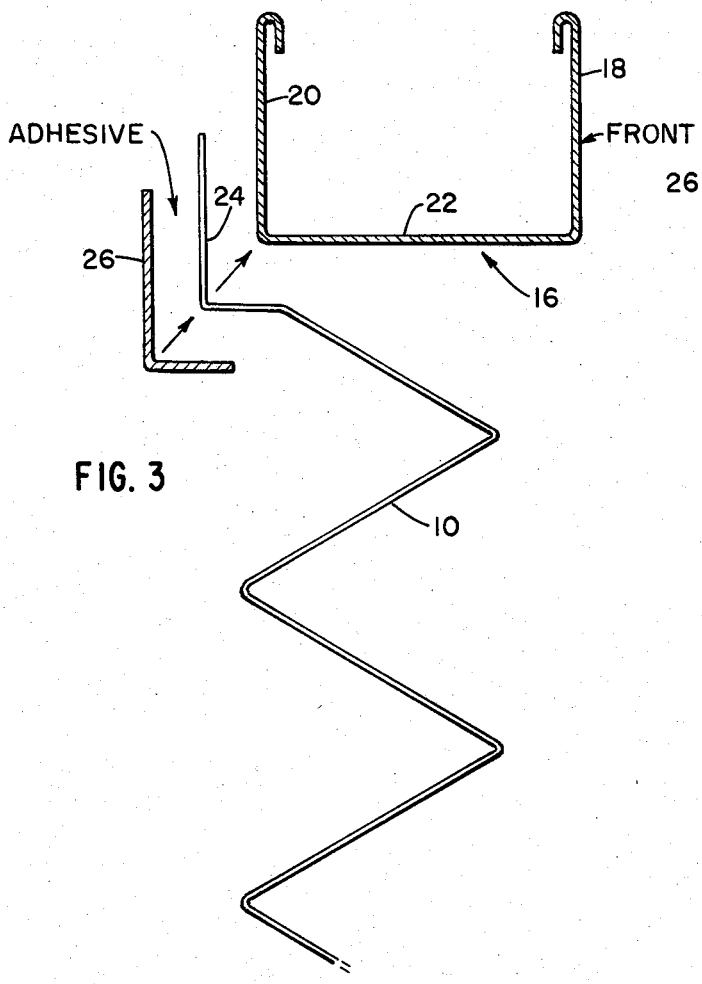
FIG. 3
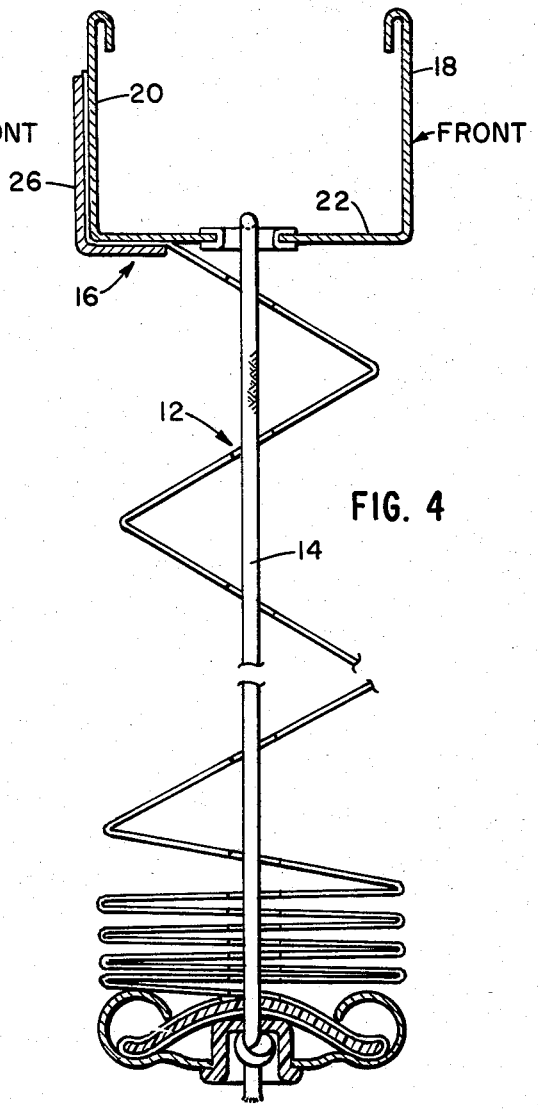
FIG. 4

FIG. 5
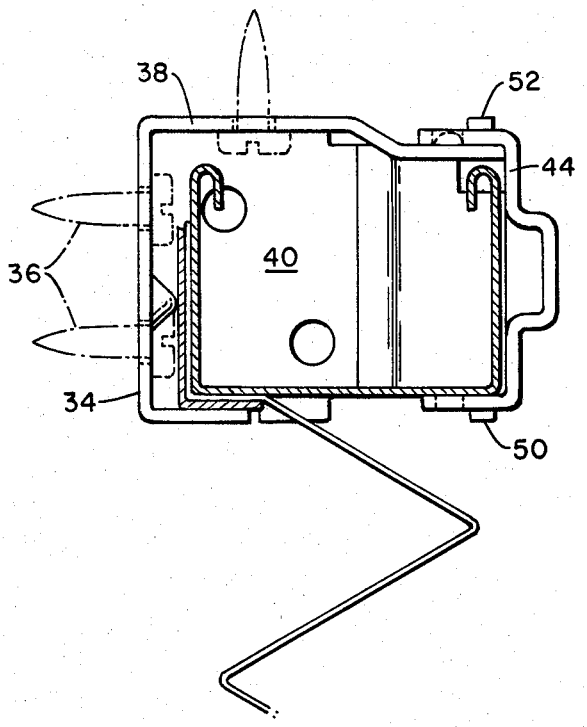
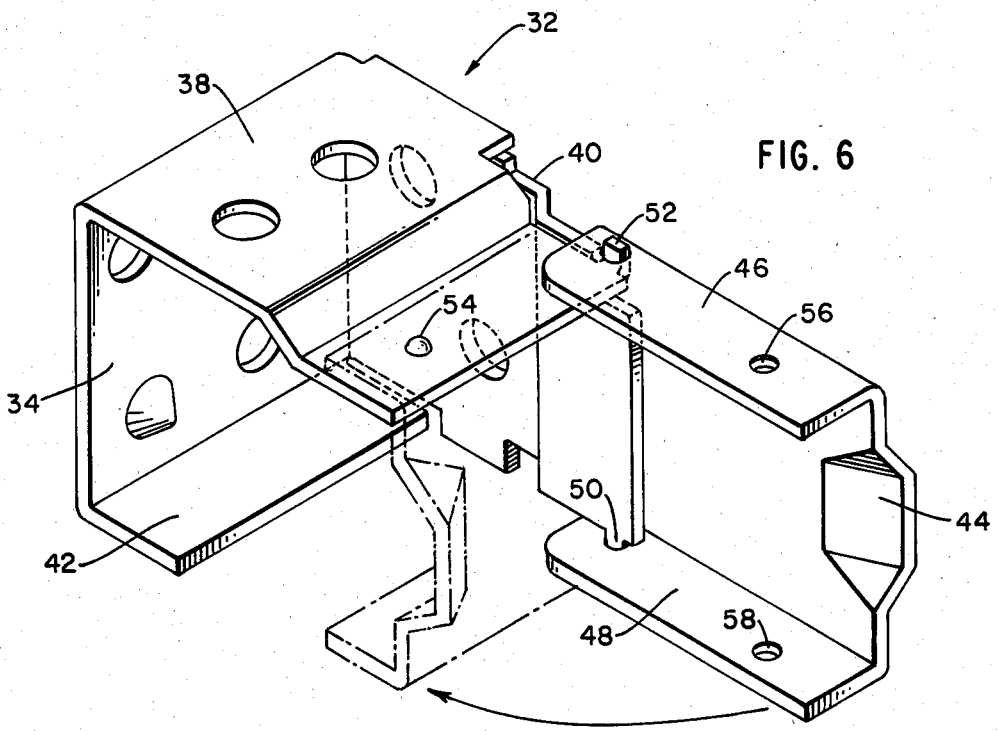
FIG. 6

MOUNTING FOR BLIND

BACKGROUND OF THE INVENTION (1) Field of the Invention

This invention relates to retractable window blinds and more particularly to headrails for blinds and brackets for supporting same.

(2) Background Art

Retractable horizontally pleated blinds have been in use for many years. They have generally employed a headrail to which the upper margin of the blind is secured and brackets have been provided to support the rail at each end. Pull cords are provided in the same manner as those used in venetian blinds with one cord extending vertically downward on each side of the blind through perforations centrally of each pleat. In one form, for reasons of economy of space, appearance, and improved operation, the length of the headrail is the same as the width of the blind material. The upper margin of the blind material is secured to the headrail, and must be notched at each end to permit the ends of the headrail to drop down into the brackets. Such an arrangement has several drawbacks. First, the notching of the upper margin of the blind results in an undesireable opening in the blind at its upper corners when the blind is lowered. Second, since the blind is supported along a line at the rear of the headrail, it tends to hang to the rear rather than directly under the headrail. An object of the present invention, therefore, is to overcome these drawbacks to the currently employed pleated blinds.

Another drawback of the brackets currently being employed for mounting the headrail of blinds (either venetian or pleated) relates to the necessity of mounting the brackets on a horizontal overhead wall (ceiling) or on a vertical wall either parallel or normal to the headrail. With the brackets currently available, a housing is provided in which it is difficult to gain access with one's fingers into the interior of the housing in order to locate the screw holes and position the screws. Also, the currently available brackets are made entirely as righthand and lefthand brackets and have no parts capable of serving in connection with both ends. Accordingly, other objects of this invention include the provision of brackets for supporting headrails for blinds wherein the brackets provide full access of one's fingers to the interior of the bracket housing. Additionally an object is to provide brackets of which at least a part may be employed interchangeably to support either the righthand or the lefthand end of the headrail of a blind.

SUMMARY

In the present invention, the drawbacks of the conventional form of brackets and pleated blinds described are overcome in the case of the pleated blind by securing the top margin of the blind material throughout the full length of the headrail both to the back of the headrail and part-way under the bottom of the headrail. The securement is fixed by employing an L-shaped retaining member to sandwich the upper margin of the blind material against the rear and under surface of the headrail. The headrail is mounted in end brackets comprising a housing with walls adapted for securement to the vertical and horizontal walls of a window frame or the like. The housing is open at the bottom but is provided with a short flange adjacent to the rear for supporting the rear margin of the headrail. The front of the bracket housing is provided with a pivotally mounted front plate which has flanges which snap over and support the end of the headrail. Access to the interior of the housing is provided by the open bottom and by the pivoting of the front plate. In the case of supporting a pleated blind, the blind material is secured to the headrail and the ends of the headrail are supported by the brackets without requiring the blind material to be notched to accommodate the brackets. Also, the line of support for the pleated blind material is not at the rear of the headrail but is part-way to the front of the bottom of the headrail. Only the housing part of the bracket must be made for the righthand and lefthand ends, the front plates being interchangeable by simple inversion.

BRIEF DESCRIPTION OF THE DRAWINGS

A preferred embodiment of the invention is illustrated in the accompanying drawings in which:

FIG. 1 is a view in front elevation of a pleated blind employing the present invention;

FIG. 2 is a view in side elevation of the blind of FIG. 1;

FIG. 3 is an exploded view in side elevation showing separately a headrail, blind material, and retaining member as employed in the invention;

FIG. 4 is a cross-sectional view in side elevation along the lines 4—4 of FIG. 1;

FIG. 5 is a cross-sectional view in side elevation along the lines 5—5 of FIG. 1 showing the righthand end bracket; and FIG. 6 is a perspective view of the end bracket of FIG. 5.

DESCRIPTION OF PREFERRED EMBODIMENT

A pleated blind mounted in the bracket of the present invention herein shown comprises a sheet of blind material 10 horizontally pleated and perforated as indicated at 12 to accommodate draw cords 14 in the conventional manner.

A headrail indicated generally at 16, in the form of a U-shaped channel, comprises a front wall 18, a rear wall 20, and a bottom wall 22, and is employed to support the pleated blind material 10. This is done by means of an extended upper margin 24 on sheet 10 which is sandwiched against rear wall 20 and the rear margin of bottom wall 22 by means of an L-shaped retaining member 26. Doublefaced adhesive tape and/or staples may be employed to hold retaining member 26 firmly against wall 20 so as to preclude relative motion between the blind material and the headrail 16.

It will be noted that the foot portion of L-shaped member 26 extends toward the front under the rear margin of bottom wall 22 of headrail 16, and thereby it provides a line of support for blind material 10 which is part-way to the front of headrail 16.

The lefthand and righthand ends of headrail 16 are supported respectively by a lefthand bracket 28 and a righthand bracket 30. The righthand bracket 30 is shown in FIGS. 5 and 6, and it comprises a housing indicated generally at 32 including a rear wall 34 adapted to be secured, for example, by screws 36 shown in phantom in FIG. 5. The housing 32 also includes a top wall 38, an end wall 40 and a bottom flange 42, which extends forward part-way across the bottom of housing 32 from the lower end of rear wall 34. A front plate 44 having an upper flange 46 and a lower flange 48 is pivotally mounted to the housing 32 to swing from an opened position shown in FIG. 6 to a closed position shown in FIG. 5. The pivotal connection is made by means of a bottom lug 50 on the lower front end of end wall 40, and a top lug 52 on the upper front end of top wall 38 fitting into appropriately located holes in the respective flanges 48 and 46 of front plate 44. End wall 40 and top wall 38 abut and are secured to each other only from the rear to the middle of housing 32. In this way, top lug 52 can be depressed relative to bottom lug 50 to facilitate the insertion of lugs 50 and 52 in the holes in flanges 46 and 48 of front plate 44. An upstanding detent 54 is provided on the upper surface of top wall 38 in position to fit into hole 56 of flange 46 to hold front plate 44 in the closed position. Top wall 38 and end wall 40 are also provided with screw holes to facilitate securing the bracket to a ceiling or wall at right angles to the headrail 16 as may be desired. The forward portion of end wall 40 on which lug 50 is located, is set inwardly to provide pivotal clearance for flanges 46 and 48 of cover plate 44 when the bracket is mounted on a wall with end wall 40 in abutment with the wall.

In operation, the bracket 30 is secured to the supporting wall, window frame or the like with the front plate 44 pivoted to the opened position to facilitate access to the interior. Next, the righthand end of headrail 16 is inserted into housing 32 with the rear margin of the headrail 15 resting on flange 42. Front plate 44 is then pivoted closed and snapped onto detent 54 in which position, lower flange 48 of front plate 44 supports the front margin of headrail 16. In this way, the bracket 30 fully supports headrail 16 and does it in such a way that the blind material 10 can extend to the end of headrail 16 without having to be notched.

The housing of lefthand bracket 28 need not be described in detail because it is simply a mirror image of housing 32 of bracket 30 as will be readily understood by those skilled in the art. It is worth noting, however, that front plate 44 serves for either bracket simply by turning it over, and it is provided with a second hole, i.e., hole 58 to accommodate a detent on bracket 28 corresponding to detent 54 of bracket 30, when front plate 44 is inverted for use in bracket 28.

Having thus described a preferred embodiment, it will now be apparent to those skilled in the art that various modifications of the specific structure will be feasible without departing from the spirit of the invention. It, therefore, is not intended that the invention be confined to the precise form herein shown but to be limited only in terms of the appended claims.

I claim:

1. An end bracket for supporting a headrail comprising:

(a) a generally rectangular housing having a rear wall, a top wall, an end wall, at least one of said walls adapted for securement to a support, and an open bottom;

(b) a rear bottom flange for supporting the rear margin of said headrail extending foward from the bottom of the rear wall of said housing and extending only partially across the open bottom;

(c) a front plate for said housing; and (d) means for pivotally connecting said front plate to said housing to pivot from an opened position in which the interior of said housing is exposed, to a closed position in which said front plate is in position to support said headrail such that there exists a gap between the front plate in the closed position and the rear bottom flange for a blind suspended midway of the depth of the headrail.

2. The bracket for supporting a headrail defined in claim 1 further comprising:

spring means for detachably connecting said front plate to said housing.

3. The bracket for supporting a headrail defined in claim 1 further comprising:

a pair of said housings one of which is adapted to support a righthand end of said headrail and the other of which is adapted to support a lefthand end thereof; and means for connecting said front plate to either one of said pair of housings.

4. The bracket for supporting a headrail defined in claim 1 further comprising:

spring detent means for releasably holding said front plate in the closed position.

5. A retractable pleated blind, comprising:

(a) a sheet of horizontally pleated blind material having an upper margin;

(b) a headrail for supporting the sheet of horizontally pleated material comprising an elongated U-shaped channel having front, rear, and bottom walls, said bottom wall having a rear margin of less than the width of said bottom wall adjacent to said rear wall;

(c) means extending substantially along the length of the headrail for securing the upper margin of the sheet of horizontally pleated material to the rear wall and to the rear margin only of the bottom wall of the headrail; and (d) end brackets for supporting ends of said headrail, each bracket comprising a housing having a rear wall adapted for securement to a support, a bottom flange for supporting the headrail only in the area of the rear margin of the bottom wall of and releasable means for holding the headrail in each bracket such that there exists a gap between the bottom flange and the releasable holding means for the blind.

6. The retractable pleated blind defined in claim 5, further characterized by:

said securing means comprising an elongated L-shaped retaining member adapted to sandwich the upper margin of the sheet of horizontally pleated material between itself and the rear wall and rear margin only of the bottom wall of the headrail; and means for holding said retaining member tightly against the headrail to prevent relative motion between the upper margin of the sheet of horizontally pleated material and the rear wall of the headrail.

7. The retractable pleated blind defined in claim 5, further characterized by:

the releasable means for holding the headrail in each bracket, comprising a front plate, means for pivotally connecting said front plate to said housing to pivot from an opened position in which an end of the headrail can be inserted in said housing to a closed position in which said front plate holds the end of the headrail within said housing, and detent means associated with said housing for releasably holding said front plate in said closed position.

8. The bracket for supporting a headrail defined in claim 1, further comprising:

a front bottom flange for supporting the forward margin of said headrail extending rearward from the bottom of the front plate, such that when said front plate is in a closed position there is a gap between the front and rear bottom flanges.

9. A retractable pleated blind, comprising:

a sheet of horizontally pleated blind material having an upper margin;

a headrail for supporting the sheet of horizontally pleated material comprising a bottom wall;

means for securing the upper margin of the sheet of horizontally pleated material to the headrail such that the sheet of horizontally pleated material is suspended from a center portion of the bottom wall end brackets for supporting ends of said headrail, each bracket comprising a rear wall adapted for securement to a support, a front wall for holding the headrail in the bracket, a bottom flange extending forwardly from the rear wall, and a bottom flange extending rearwardly from the front wall, said flanges arranged so as to support the headrail such that the sheet of horizontally pleated material extends between the two flanges.

10. The retractable pleated blind according to claim 9, wherein the front wall is pivotally connected to each bracket such that the front wall can be moved from a closed position wherein the headrail is held within the bracket to an open position wherein the headrail can be removed from the bracket.

* * * * *